US005464269A

United States Patent [19]

Mizelle

[11] Patent Number: 5,464,269

[45] Date of Patent: Nov. 7, 1995

[54] UPHOLSTERED FURNITURE AND MOVABLE HEADREST

[76] Inventor: Ned W. Mizelle, P.O. Box 5985, High Point, N.C. 27262

[21] Appl. No.: 134,793

[22] Filed: Oct. 12, 1993

[51] Int. Cl.[6] ..... A47C 1/02

[52] U.S. Cl. ..... 297/61; 297/403; 297/408

[58] Field of Search ..... 297/61, 403, 404, 297/408

[56] References Cited

U.S. PATENT DOCUMENTS

| | | | |
|---|---|---|---|
| 2,859,797 | 11/1958 | Mitchelson | 297/61 |
| 2,869,619 | 1/1959 | Petersen et al. | 297/61 |
| 2,952,303 | 9/1960 | Spound et al. | 297/61 |
| 3,547,486 | 12/1970 | Herzer | 297/408 |
| 4,711,494 | 12/1987 | Duvenkamp | 297/403 |

*Primary Examiner*—Richard A. Bertsch
*Assistant Examiner*—Charles G. Freay
*Attorney, Agent, or Firm*—Beveridge, DeGrandi, Weilacher & Young

[57] ABSTRACT

The headrest of an upholstered seating unit is hingedly supported by a spring which biases the headrest to a substantially vertical raised position. The spring prevents the headrest from moving from its raised position when an occupant's head rests against it, but greater forces will bend the spring and move the headrest to a generally horizontal lowered position. The illustrated spring is a pretensioned vertical helical spring which has its lower end mounted forwardly of an upper portion of the furniture frame. The headrest can be moved to its lowered position by a cable/conduit associated with a pair of relatively movable parts of the furniture unit.

38 Claims, 5 Drawing Sheets

130
136
132
142
142
136
132
130
134
138
140

UPHOLSTERED FURNITURE AND MOVABLE HEADREST

BACKGROUND OF THE INVENTION

This invention relates to upholstered furniture pieces which have movable headrests.

The furniture industry has recognized the desirability of providing upholstered seating units with headrests which can be raised and lowered. Such a capability is particularly useful in sectional furniture in which the units of a set have different characteristics. For example, a raisable headrest may be a more important feature in a reclining section than in a stationary section or corner unit. By providing a raisable headrest in a reclining section, it is possible to provide lower backs on all units in the set.

There are existing mechanisms in which links and levers are used to raise and lower headrests. Such mechanisms add significantly to the manufacturer's cost of materials, and they also tend to detract from the appearance of the units because they have unsightly mechanical components which are visible when the headrests are raised.

The present invention is believed to offer a suitable alternative to linkage-supported raisable headrests, and it is significantly less expensive and aesthetically more pleasing than mechanisms previously used for this purpose.

SUMMARY OF THE INVENTION

The present invention relates to a headrest support and to furniture units which are provided with headrest supports.

In one respect, the invention involves a headrest support which includes a mounting means which is attachable to an upper portion of the frame of a furniture seating unit. A pair of laterally spaced helical springs each have a lower end portion mounted on the mounting means. A headrest frame is mounted on the upper end portions of the springs so that the springs support the headrest frame for rearward movement from a generally vertical raised position to a generally horizontal lowered position. The springs resiliently bias the headrest frame to the raised position, and they have a stiffness which prevents movement of the headrest frame to the lowered position in response to forces exerted thereon by a seated occupant's head. The stiffness of the springs is such that the headrest can be moved from its raised position to its lowered position in response to forces which are greater than forces exerted on the headrest frame by a seated occupant's head. Releasable means are provided for retaining the headrest frame in its lowered position.

In another respect, the invention involves a forwardly cantilevered support for the springs of a headrest frame. More specifically, a furniture seating unit with a raisable headrest has a spring which has a lower portion mounted on a mounting means which is attached to and cantilevered forwardly of the upper portion of the frame of the furniture unit. A headrest frame is mounted on the upper portion of the spring so that the spring supports the headrest frame for rearward movement from a generally vertical raised position to a generally horizontal lowered position. The spring resiliently biases the headrest frame to the raised position. The stiffness of the spring is such that the headrest frame is prevented from moving to its lowered position when forces are exerted thereon by a seated occupant's head, but the headrest frame is movable to its lowered position in response to greater forces than those exerted thereon by an occupant's head. Means are provided for retaining the headrest frame in its lowered position.

From still another perspective, the invention relates to a novel manner of controlling the movement of the headrest of a furniture seating unit. The seating unit has two relatively moveable parts selected from the group consisting of a base, a seat, an arm, a back, and a legrest. Means are provided for mounting one of these parts for movement between a first position and a second position relative to another one of these parts. The headrest itself has a pair of laterally spaced springs mounted on an upper portion of the seating unit, and a headrest frame mounted on and supported by the springs so that the headrest is movable rearwardly from a generally vertical raised position to a generally horizontal lowered position. The springs resiliently bias the headrest frame to the raised position. The stiffness of the springs is such that they prevent movement of the headrest frame to the lowered position in response to forces exerted thereon by a seated occupant's head, but they are sufficiently stiff to prevent movement of the headrest frame to the lowered position in response to forces greater than those exerted thereon by an occupant's head. A control means is operable to retain the headrest frame in its lowered position when the movable part (typically a legrest or a seat) is in its first position, and for releasing the headrest for movement to its raised position when the movable part is in its second position.

Preferably, the invention in its various forms is used in conjunction with a furniture piece in which the headrest frame is embedded in an upholstery filling material, and the filling material is covered by an upholstery fabric to provide a "pillow back" type appearance. There are substantially equal thicknesses of filling material in front of and behind the spring so that the spring is located at a position which is substantially neutral with respect to bending of the filling material. The headrest, in some instances, can be moved manually, and the releasable means for retaining it in its lowered position can be manually engaged and disengaged. The latter can be performed by fastener means, preferably a hook-and-loop fabric material. The springs are helical springs which have axes which are generally vertical when the headrest frame is in its raised position.

The headrest retaining and control means preferably includes a cable/conduit device which can be operated by a handle or by relative movement between two components of the seating units. Movement of a seat relative to a base, or movement of a legrest relative to a seat can be used to operate the control means to move the headrest frame automatically. To reduce noises when the springs bend as the headrest moves from its raised position to its lowered position, the springs are prebent in a lateral direction.

The invention may take many different forms, only a few of which are disclosed in the following drawings and description.

DETAILED DESCRIPTION

Figure 1:
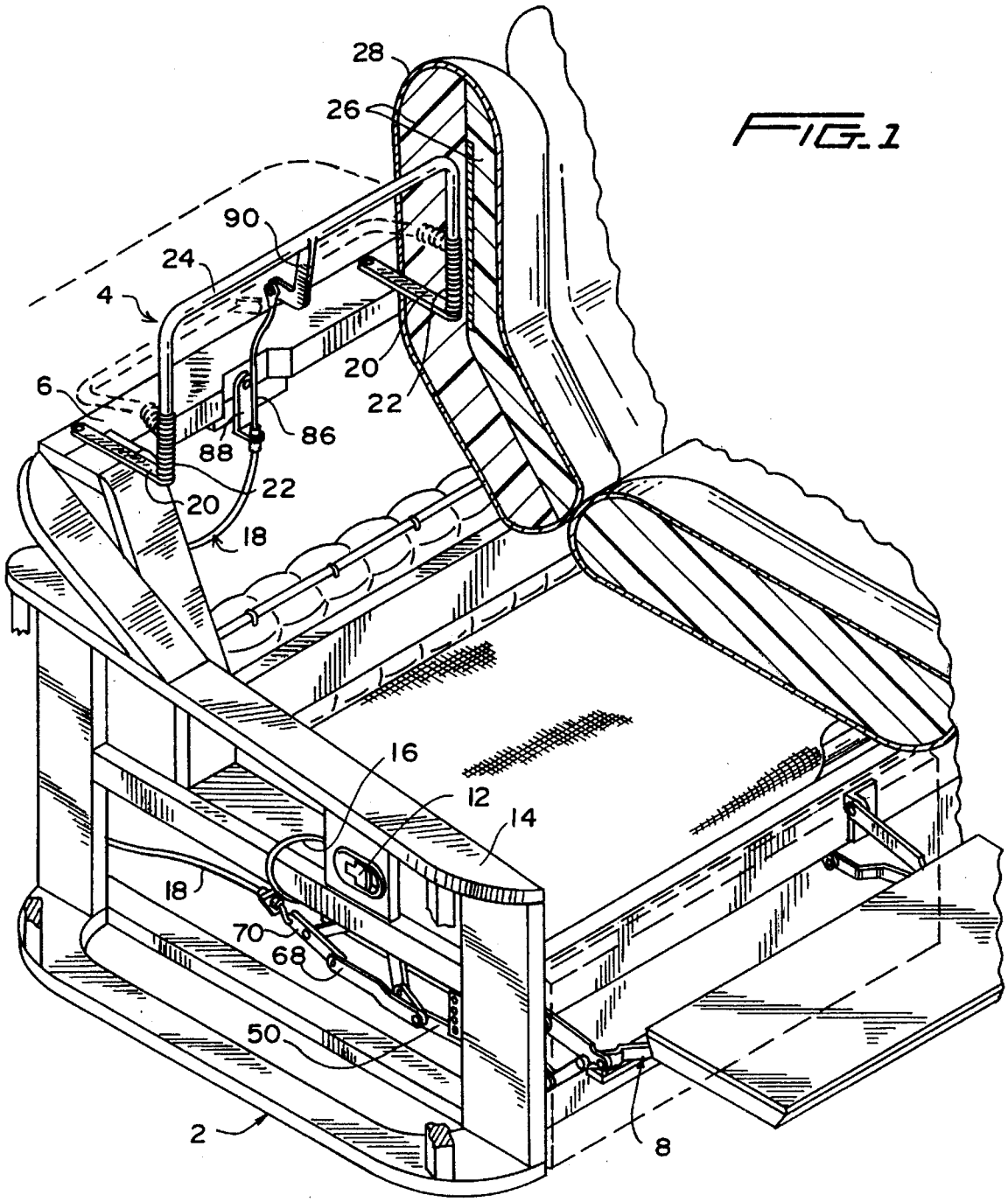
FIG. 1 is a fragmentary perspective view of a sofa sleeper unit constructed according to the invention, in which the upholstery materials have been cut away to show the frame and portions of the mechanisms.

FIG. 1 shows a two cushion sofa sleeper unit with a headrest mechanism constructed according to the invention. The unit has a frame 2, a headrest assembly 4 mounted on the top back rail 6 of the frame, and an extensible legrest mechanism 8 which has a stationary mounting bracket 10 fixed to the side of the frame. A manually operated lever 12 of conventional construction is mounted on the arm 14 and is connected by a cable/conduit 16 to the legrest mechanism 8. Another cable/conduit assembly 18 extends from the legrest mechanism 8 to the headrest assembly 4.

The headrest assembly 4 includes a pair of mounting brackets 20, an inverted U-shaped frame 24 made of metal tubing, and two helical springs which provide a pivotless hinge between the brackets 20 and the frame 24.

Each of the mounting brackets 20 has a rear end which is fixed by screws to an upper portion of the frame, preferably the top back rail 6. The brackets 20 are cantilevered forwardly from the frame, and the springs 22 are mounted at the forward ends of the brackets. The lower ends of the springs 22 are press fitted onto studs which are staked to the upper surfaces of the brackets 20 at their forward ends. The ends of the frame 24 are press fitted into the upper ends of the springs.

The springs 22 support the headrest frame 24 for rearward movement from the generally raised position shown in solid lines to the generally horizontal lowered position shown in broken lines 22'. The springs 22 are stiff enough to prevent the headrest frame from moving to its lowered position when forces of about 4–6 pounds are exerted on it by a seated occupant's head.

Each spring 22 is pretensioned in the respect that the cross section of the spring wire is torsionally stressed, even when no external forces are applied to the spring. Thus, adjacent turns of the spring exert axial forces against each other. This stiffens the spring 22 and causes it to resist any bending action when it is subjected to lateral forces.

Figure 4:
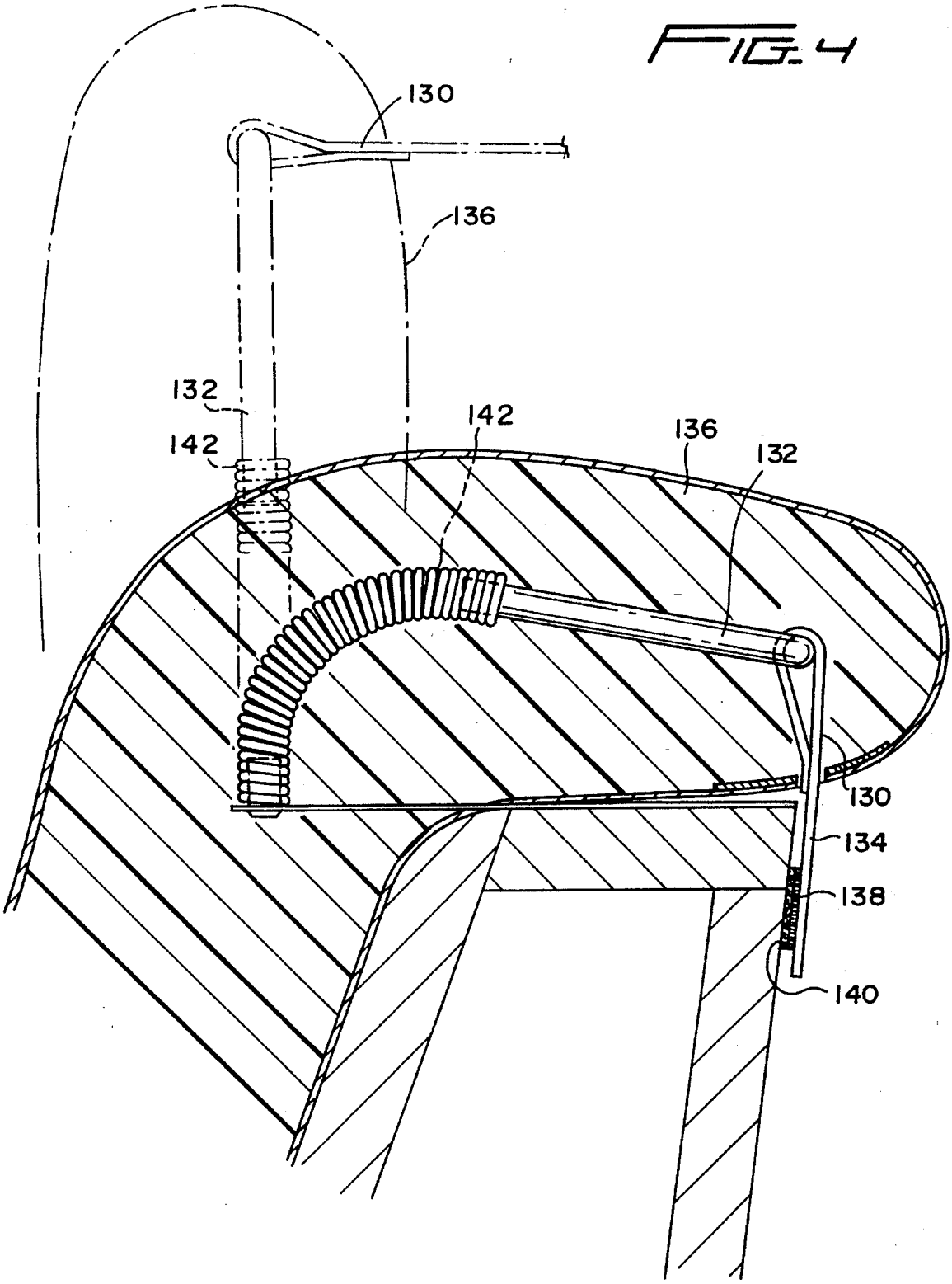
FIG. 4 shows a third embodiment of the invention in which a manually releasable means is provided for retaining the headrest in its lowered position.

FIG. 4 provides additional details with regard to the configuration of the spring, where it will be noted that along the entire concave arc defined by the bent spring, the turns of the spring act as multiple pivots. All coils are in contact, and they form a continuous arc of at least 90 degrees.

The stiffness of the springs is such that the headrest frame can be moved back to its lowered position when it is subjected to manual or mechanical forces which are greater than forces which are exerted on the headrest by an occupant's head. For example, forces of about 12–14 pounds are sufficient to move the headrest to its lowered position.

Figure 5:
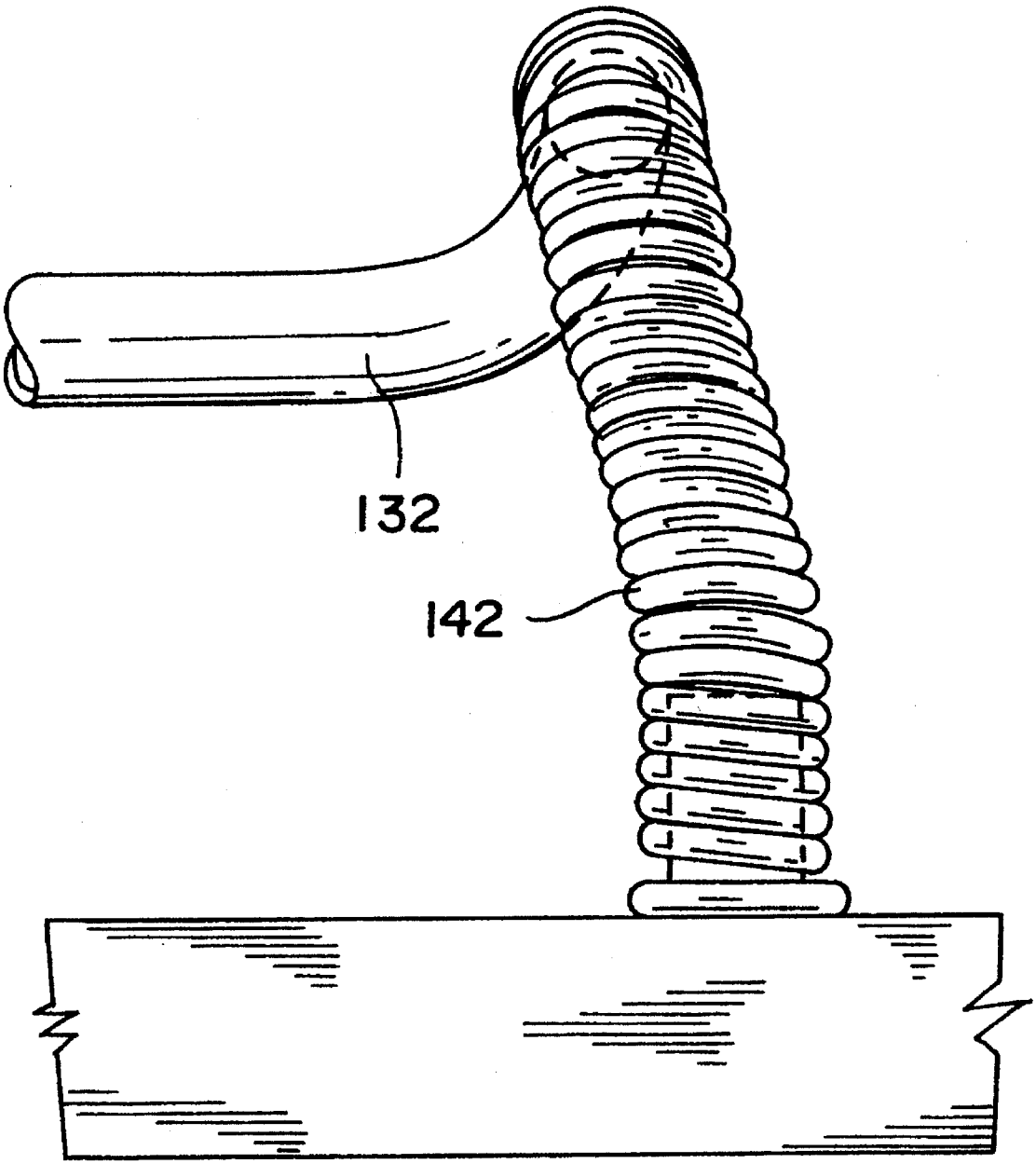
FIG. 5 is a front view of the bracket, spring, and frame when the headrest is in its lowered position, illustrating the laterally offset relationship between the opposite ends of the spring to avoid noises which otherwise occur when the spring is bent.

For noise avoidance, the springs can be slightly prebent in a lateral direction, preferably in a shallow "S" shape in a direction other than the hinging direction. This configuration, shown in FIG. 5, reduces or eliminates noises when the springs bend as the headrest moves from its raised to its lowered position.

As shown in FIG. 1, the headrest frame 24 is embedded in an upholstery filling material 26 which is covered by an upholstery fabric 28. Substantially equal thicknesses of filling material are provided in front of and behind the springs 22 and frame 24, thus placing the springs 22 and frame 24 at positions which are substantially neutral with respect to bending of the filling material. Due to the location of the mechanism, the exposed surface of the upholstery fabric is taut when the headrest is horizontal, and the cover is relatively smooth in appearance in both its raised and lowered positions.

In the embodiment of FIG. 1, the headrest 4 is releasably retained in its lowered position by the cable/conduit assembly 18 which connects the headrest to the extensible legrest mechanism 8.

Figure 2:
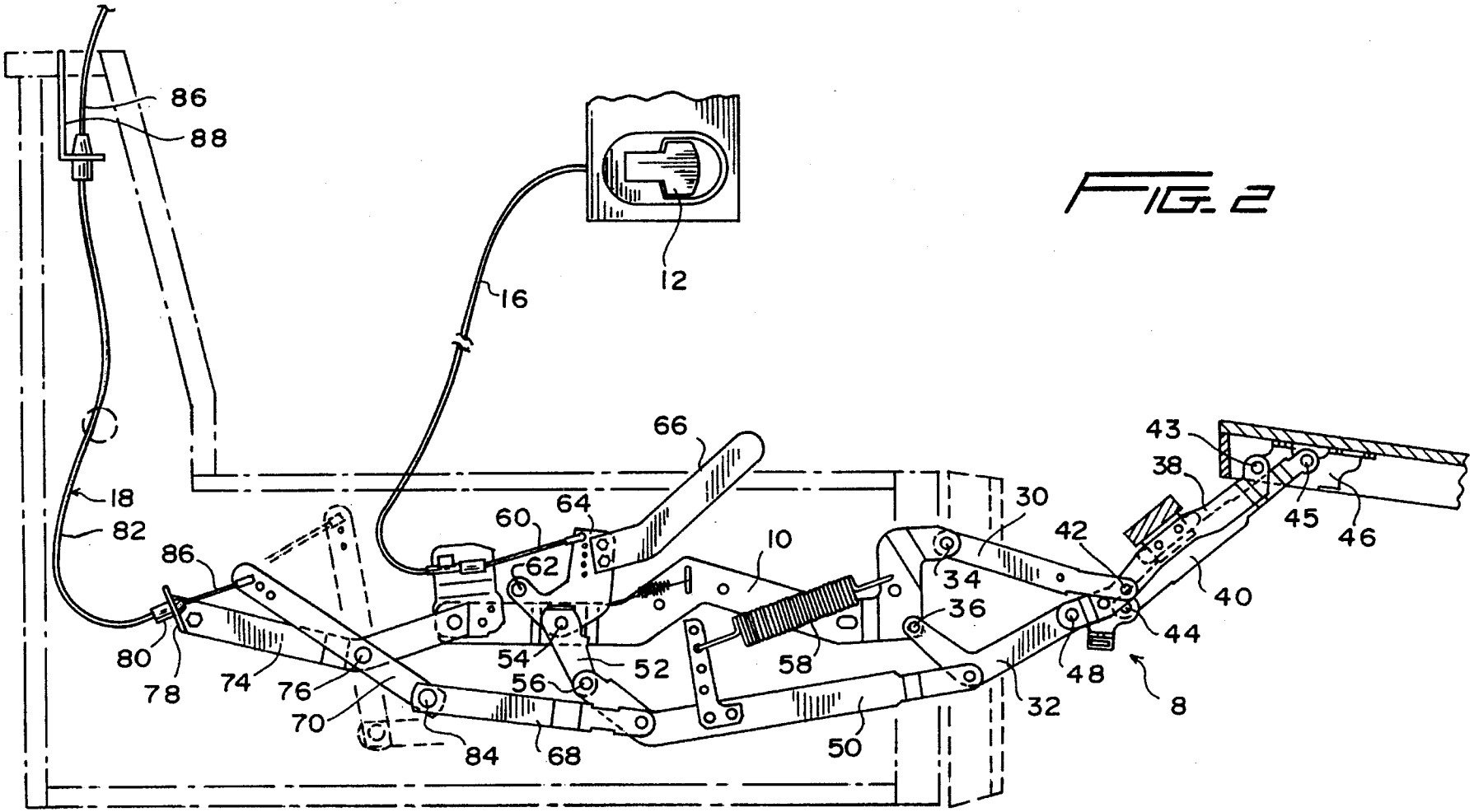
FIG. 2 is a side view of the unit of FIG. 2, showing the legrest mechanism and cable/conduit devices connected thereto.

Details of the legrest mechanism 8 are shown in FIG. 2. It has a stationary mounting bracket 10, a pair of rear links 30 and 32 which are pivotally supported on the bracket 10 at pivots 34 and 36, a pair of front links 38 and 40 which have their rear ends pivotally connected to the links 30 and 32 at 42 and 44, respectively. The front ends of the front links 38 and 40 are pivoted at 43 and 45 to the legrest bracket 46. The link 38 has an integral rear extension 38' which is connected to the link 32 at a pivot 48 which lies between the pivots 36 and 44.

The legrest mechanism 8 has an actuator arm 50 which is normally held in a retracted position by a link 52. This link 52 and an actuator lever 64 are mounted on a bracket 10 by a stationary pivot 54, and the link 52 is connected to the actuator arm 50 by a pivot 56. A spring 58 holds the pivot 56 in over-center relation relative to pivot 54 when the mechanism is in its retracted configuration. However, when an occupant pulls the armrest lever 12, the cable 60 of cable/conduit 16 is pulled to move the actuator lever 64 in a counter clockwise direction. A stop 62 on lever 64 engages and drives the link 52 in a counter clockwise direction until pivot 56 moves below its over-center position. The spring 58 then drives the arm 50 forwardly until the legrest mechanism 8 is fully extended. A handle 66 may be fixed directly to the actuator lever for use in furniture pieces which do not use a cable/conduit unit 16.

Movement of the legrest mechanism 8 is transmitted to the headrest assembly 4 by a link 68, a lever 70, and the cable/conduit assembly 18. A stationary bracket 74 is rigidly affixed to the legrest mounting bracket 10 to provide a stationary pivot 76 for the lever 70 and a stationary mounting flange 78 for one end 80 of the conduit 82 of the cable/conduit assembly 18.

A stop (not shown) on the arm 50 abuts the upper edge of the link 68 to limit the extent of clockwise movement of the link 68 relative to the legrest actuator arm 50. The rear end of the link 68 is connected by pivot 84 to the lower end of the lever 70 which is supported on the stationary pivot 76. The cable 86 of the assembly 18 has its lower end connected to the upper end of lever 70.

As shown in FIG. 1, the upper end of the conduit 82 is anchored by a bracket 88 to the top back rail 6 of the frame 2, and the upper end of the cable 86 is connected to an arm 90 which is rigidly attached to the headrest frame 24.

When the unit of FIGS. 1 and 2 is in its normal seating configuration, the legrest is retracted and the headrest is in its lowered position. The cable 86 is under sufficient tension to hold the headrest frame 24 down against the uprighting forces of the springs 22. When the occupant pulls on the lever 12, the cable 60 pulls lever 64 which moves the link 52 until pivot 56 moves down beyond its dead center position. The spring 58 then drives the actuator arm 50 forwardly to move the links 30, 32, 38, 40 and legrest bracket 46 to their extended positions. This movement of the actuator arm 50 also drives the link 68 and lever 70 to relieve tension in the cable 86, thus freeing the headrest 24 so that the springs 22 move the headrest to its raised position.

When the unit is returned to its normal seating configuration, the legrest 46 and associated links are moved rearwardly. This drives the actuator arm 50, link 68, and the lower arm of lever 70 rearwardly, thus providing forward movement of the upper arm of the lever 70 to tension the cable 86 and pull the headrest back down to its normal, lowered, pillow-back position.

Figure 3:
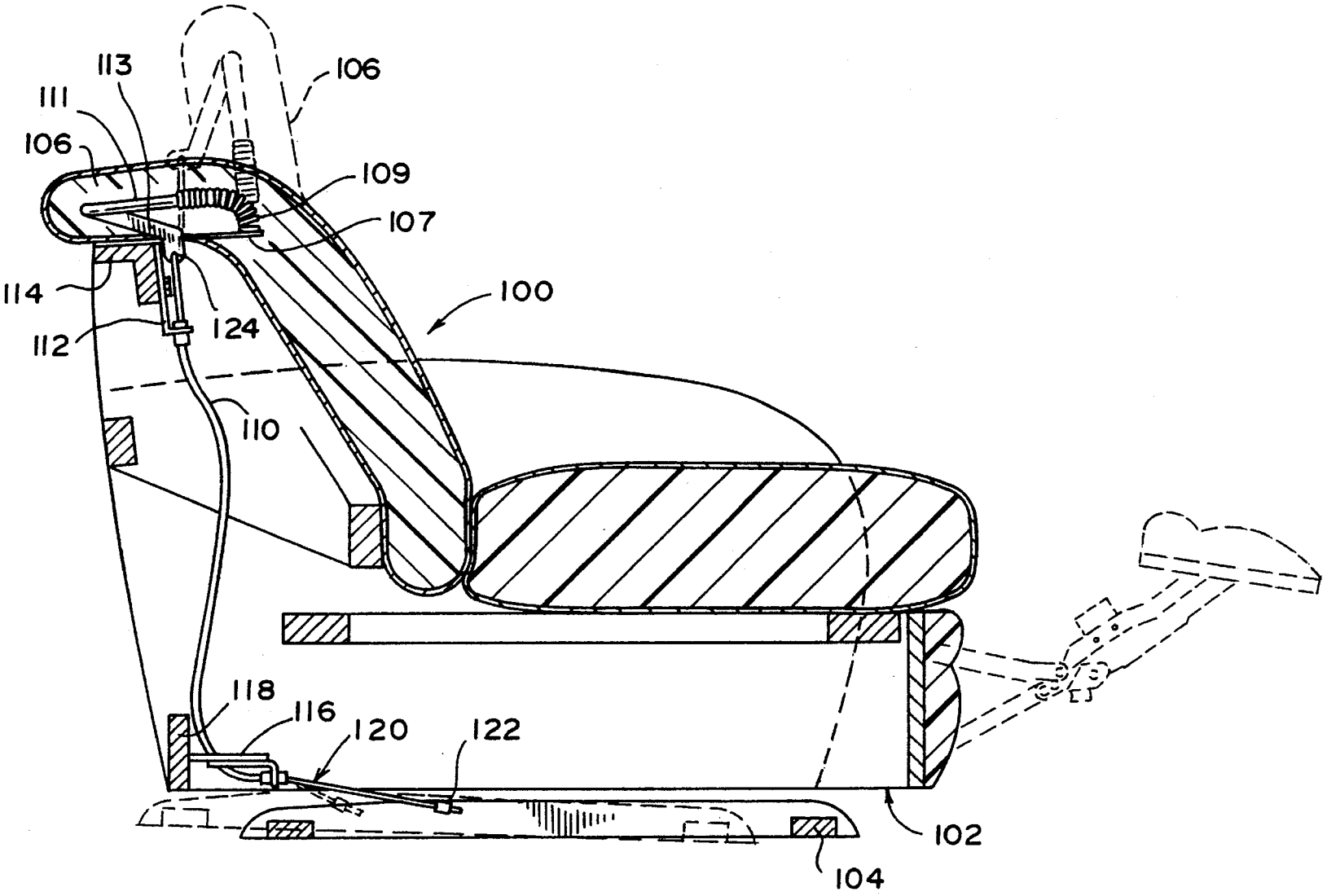
FIG. 3 is a side sectional view of a second embodiment of the invention in which the headrest is operated in response to movement of a chassis relative to the base of a wall proximity recliner unit.

FIG. 3 shows another way in which a headrest is raised and lowered by relative movement which occurs between elements of a seating unit. In this case, a chair 100 has a wall proximity type mechanism which mounts a movable chair chassis 102 on a stationary base 104. Such mechanisms are commercially available and are well known in the furniture manufacturing industry. The chassis 102 includes the seat, arms, and back, and it is movable from a normal seating position to an inclined position which is forward of and slightly rearwardly pitched from the normal position. The relative positions of the base, legrest, and headrest relative to the chassis when the unit is in the inclined position are shown in broken lines in FIG. 3.

In the chair of FIG. 3, the headrest 106 has mounting brackets 107, springs 109, and a frame 111 with an arm 113. These components are identical to those shown in FIGS. 1 and 2. The headrest 106 moves automatically from its normal lowered position shown in solid lines to the raised position shown in broken lines in response to movement of the chassis 102 relative to the base 104. This motion is transmitted to the headrest 106 by a cable/conduit device 108. The conduit 110 has an upper end fixed by a bracket 112 to the top back rail 114, and its lower end is fixed by a similar bracket 116 to the bottom back rail 118 of the chassis. The cable 120 has a lower end 122 fixed to the chair base 104, and an upper end 124 which is connected to the arm 113 which is rigidly fixed to the headrest frame 111.

From the foregoing, it will be recognized that the headrest 106 shown in FIG. 3 is normally is held in its lowered position by the cable 120 which pulls the arm 113 to hold the springs 109 in their bent configuration. When the chair is activated, the chassis 102 moves relative to the base in a direction which relieves tension in the cable 120 and releases the headrest 106 so that the resilient springs 109 will move the headrest to its raised position. The cable 120 slides upwardly in the conduit 110.

Subsequent movement of the chair from its inclined position to its normal seating position will pull the cable 120 and the headrest until the headrest 106 returns to its lowered position.

In lieu of mechanical type activation, it is possible to operate the headrest by applying manual pressure directly to the headrest. A simple arrangement of this type is shown in FIG. 4 which shows a relatively narrow belt 130 of fabric which is fixed around the headrest frame 132 and extends rearwardly through an opening in the upholstery fabric to provide an exposed tab portion 134 behind the headrest 136. The tab 134 has a fastener, preferably of hook-and-loop fabric 138, which is engagable with a cooperating piece of material 140 on the rear of the furniture piece. Snaps, eyes, hooks, latches, or other types of fasteners may alternatively be used.

The headrest of FIG. 4 will normally be held in its lowered position by the tab 134 as shown in solid lines. To raise the headrest 136, the user will pull on the tab 134 to release the fastener material. The springs 142 will then bias the headrest to its raised head-supporting position. To return the headrest 136 to its lowered position, the user may push or pull it backwardly and refasten the fastener material 138, 140.

From the foregoing, it will be appreciated that this invention provides an uncomplicated and effective device for supporting a movable headrest for manual or automatic operation. An upholstered seating unit constructed according to the invention is compatible with modern styles, particularly those which utilize a pillow back appearance. Furthermore, the invention does not detract from the aesthetic appearance of the furniture piece.

Persons skilled in the art will recognize that the invention may be practiced in many ways other than those specifically disclosed herein. For example, helical torsion springs with a horizontal transverse axes may be used in association with activation by relative movement of two parts of the furniture piece. However, the pretensioned springs with a vertical axis are preferred because the springs themselves establish the orientation of the raised headrest, without reliance on any supplemental mechanical stop. Various types of relative motion may drive the headrest mechanism, and such motion can occur between any two of the basic components which include a back, an arm, a base, a seat, and a legrest. Due to the versatility of the invention, it is emphasized that it is not limited only to the disclosed embodiments but it encompasses many other embodiments which may evolve and which fall within the spirit of the following claims.

I claim:

1. A headrest support for a furniture seating unit having a frame, said headrest support comprising, mounting means for attaching said headrest support to an upper portion of the frame, a pair of laterally spaced helical springs each having an upper end portion and a lower end portion, said lower end portions of the springs being mounted on the mounting means, a headrest frame mounted on the upper end portions of the springs, said springs supporting the headrest frame for rearward movement from a generally vertical raised position to a generally horizontal lowered position, said springs resiliently biasing the headrest frame to said raised position, said springs having a stiffness which prevents movement of the headrest frame to said lowered position in response to forces exerted thereon by a seated occupant's head, said springs having a stiffness which permits movement of the headrest frame from its raised position to its lowered position in response to forces which are greater than forces exerted on the headrest frame by a seated occupant's head, and releasable means for retaining said headrest frame in its lowered position.

2. Apparatus according to claim 1 wherein said mounting means has a rear end and a front end, said rear end being constructed for attachment to an upper portion of a frame of a seating unit, said front end being forwardly spaced from said rear end and being connected to the lower end portions of said springs.

3. Apparatus according to claim 2 wherein the mounting means includes two separate members on which said springs are individually mounted.

4. Apparatus according to claim 1 wherein the headrest support is in combination with a frame of a furniture seating unit, said frame of the furniture seating unit having an upper frame portion on which said headrest support is mounted.

5. Apparatus according to claim 4 wherein the headrest frame is embedded in an upholstery filling material, and said filling material is covered by an upholstery fabric.

6. Apparatus according to claim 5 wherein there are substantially equal thicknesses of said filling material in front of and behind said spring, whereby said spring is located at a position which is substantially neutral with respect to bending of the filling material.

7. Apparatus according to claim 1 wherein the releasable means for retaining the headrest in its lowered position is manually engaged and disengaged.

8. Apparatus according to claim 7 wherein the releasable means for retaining the headrest in its lowered position is a fastener means.

9. Apparatus according to claim 8 wherein the fastener means is a hook-and-loop fabric material.

10. Apparatus according to claim 1 wherein the releasable means for retaining the headrest frame in its lowered position includes an elongated flexible member which is connected to the headrest frame, and pulling means for tensioning said elongated flexible member to move said headrest frame to its lowered position.

11. Apparatus according to claim 10 in combination with a seating unit which has parts which move relative to each other, a fixed length conduit through which said elongated flexible member runs, said elongated flexible member having one end fixed to said first part and one end fixed to said headrest frame, said conduit having at least one end fixed to said second part.

12. Apparatus according to claim 11 including a manually engageable handle operatively connected to a lever whereby movement of said handle moves the headrest frame between its raised and lowered positions.

13. Apparatus according to claim 11 wherein the first part is a stationary base and the second part includes a movable seat frame.

14. Apparatus according to claim 11 wherein the first part is a base and the second part is a link connected to an extensible legrest.

15. Apparatus according to claim 10 wherein the pulling means includes a lever connected to the elongated flexible member.

16. Apparatus according to claim 10 wherein the pulling means includes an extensible legrest mechanism provided with a legrest support which is movable between a retracted position and an extended leg-supporting position, said elongated flexible member being operatively connected to said legrest mechanism, said legrest mechanism being operable to pull said elongated flexible member in response to movement of the legrest support from its extended position to its retracted position.

17. Apparatus according to claim 1, wherein the releasable means for retaining the headrest includes a lever which is operatively connected to the headrest frame, said lever being movable between a first position and a second position, said headrest being movable from its raised position to its lowered position in response to movement of the lever from its first position to its second position.

18. Apparatus according to claim 17, including an extensible legrest mechanism provided with a legrest support which is movable between a retracted position and an extended leg-supporting position, said lever being connected to said legrest mechanism.

19. Apparatus according to claim 1 wherein said springs are helical springs which have generally vertical axes when the headrest frame is in its raised position.

20. Apparatus according to claim 19 wherein said springs are prebent in a lateral direction to reduce noises when the springs bend to move the headrest from its raised to its lowered position.

21. Apparatus according to claim 19 wherein said springs are pretensioned closed coil springs having axes which assume generally vertical linear orientations in the absence of external forces thereon.

22. A furniture seating unit comprising, a frame which includes an upper portion, a mounting means attached to said upper portion of the frame, said mounting means being cantilevered forwardly of the upper portion of the frame, a spring having an upper portion and a lower portion, said lower portion of the spring being mounted on the mounting means and being forward of the upper portion of the frame, a headrest frame mounted on the upper portion of the spring, said spring supporting the headrest frame for rearward movement from a generally vertical raised position to a generally horizontal lowered position, said spring resiliently biasing the headrest frame to said raised position where the headrest frame has an upright orientation, said spring having a stiffness which prevents movement of the headrest frame to said lowered position in response to forces exerted thereon by a seated occupant's head, said spring having a stiffness which permits movement of the headrest frame from its raised position to its lowered position in response to forces which are greater than forces exerted on the headrest frame by a seated occupant's head, and means for retaining said headrest frame in its lowered position.

23. Apparatus according to claim 22 wherein said spring is a helical spring having a vertical axis.

24. Apparatus according to claim 22 wherein there are two said springs.

25. Apparatus according to claim 22 wherein the headrest frame is embedded in an upholstery filling material, and said filling material is covered by an upholstery fabric.

26. Apparatus according to claim 25 wherein there are substantially equal thicknesses of said filling material in front of and behind said lower portion of the spring, whereby said lower portion of the spring is located at a position which is substantially neutral with respect to bending of the filling material.

27. Apparatus according to claim 22 wherein the means for retaining the headrest in its lowered position is manually engaged and disengaged.

28. Apparatus according to claim 27 wherein the means for retaining the headrest in its lowered position is a fastener means.

29. Apparatus according to claim 28 wherein the fastener means in a hook-and-loop fabric material.

30. Apparatus according to claim 22 wherein said springs are prebent in a lateral direction to reduce noises when the springs bend to move the headrest from its raised to its lowered position.

31. A furniture seating unit, comprising, a first part and a second part selected from the group consisting of a base, a seat, an arm, a back, and a legrest;

means for movably mounting said first part on said second part for movement between a first position and a second position;

a pair of laterally spaced springs mounted on an upper portion of the seating unit;

a headrest frame mounted on and supported by the springs, said springs supporting the headrest frame for rearward movement from a generally vertical raised position to a generally horizontal lowered position, said springs resiliently biasing the headrest frame to said raised position, said springs having a stiffness which prevents movement of the headrest frame to said lowered position in response to forces exerted thereon by a seated occupant's head, said springs having a stiffness which permits movement of the headrest frame from its raised position to its lowered position in response to forces which are greater than forces exerted on the headrest frame by a seated occupant's head, and headrest control means for retaining said headrest frame in its lowered position against forces of said springs when the first part is in its first position, and for releasing said headrest for movement to its raised position when said first part is in its second position.

32. Apparatus according to claim 31 wherein the springs are helical springs the axes of which are generally vertical when the headrest frame is in its lowered position.

33. Apparatus according to claim 31 wherein the headrest control means includes a cable/conduit device which has a conduit connected to said second part, and a cable which has its ends connected to said headrest frame and said first part.

34. Apparatus according to claim 31 wherein the first part includes a seat and the second part includes a base.

35. Apparatus according to claim 31 wherein the first part includes a seat and the second part includes a legrest.

36. Apparatus according to claim 31 wherein the headrest frame is embedded in an upholstery filling material, and said filling material is covered by an upholstery fabric.

37. Apparatus according to claim 34 wherein there are substantially equal thicknesses of said filling material in front of and behind said spring, whereby said spring is located at a position which is substantially neutral with respect to bending of the filling material.

38. Apparatus according to claim 31 wherein said springs are prebent in a lateral direction to reduce noises when the springs bend to move the headrest from its raised to its lowered position.

* * * * *